United States Patent [19]

Prouty

[11] 4,286,762

[45] Sep. 1, 1981

[54] KITE-LIKE FLYING DEVICE AND ACCESSORIES THEREOF

[76] Inventor: Jonathan J. Prouty, P.O. Box 3065, Boulder, Colo. 80307

[21] Appl. No.: 34,032

[22] Filed: Apr. 27, 1979

[51] Int. Cl.[3] ..... B64C 31/06

[52] U.S. Cl. ..... 244/153 R; 24/129 R; 244/155 A

[58] Field of Search ..... 244/153 R, 153 A, 154, 244/155 R, 155 A; D21/87, 88, 89, 90; 46/77, 79; 24/129 R, 129 A, 129 B

[56] References Cited

U.S. PATENT DOCUMENTS

| | | | |
|---|---|---|---|
| 2,403,212 | 7/1946 | Concepcion | 244/153 R |
| 3,317,165 | 5/1967 | Zobl | 244/155 R |
| 3,746,286 | 7/1973 | Christoffel | 244/155 A |
| 3,770,230 | 11/1973 | Johnston | 244/155 A |
| 3,954,235 | 5/1976 | Powell | 244/153 R |
| 4,076,189 | 2/1978 | Powell | 244/153 R |
| 4,105,349 | 8/1978 | Kupperman et al. | 24/129 R |
| 4,133,500 | 1/1979 | Chapman | 244/153 R |
| 4,159,087 | 6/1979 | Moomaw | 244/153 R |

FOREIGN PATENT DOCUMENTS

| | | | |
|---|---|---|---|
| 575601 | 5/1959 | Canada | 24/129 R |
| 2920538 | 11/1979 | Fed. Rep. of Germany | 244/153 R |
| 1515984 | 6/1978 | United Kingdom | 244/153 R |

*Primary Examiner*—Charles E. Frankfort

*Attorney, Agent, or Firm*—Beveridge, DeGrandi, Kline & Lunsford

[57] ABSTRACT

A kite-like flying device includes a sail, a keel stick with a larger resilient member at its leading end, and wing sticks connected to the opposide ends of a smaller resilient member the midportion of which extends laterally through the larger member to provide a resilient resistance to forward movement of the keel stick. A cross stick is flexed and received by sockets which are slightly inclined relative to each other in connector blocks slidably mounted on the wing sticks. Two strings extend from the operator to a control rod which is connected by a string harness to the kite. The connectors for connecting the strings to the control rod each include three bores through which the strings pass back and forth to provide on each side thereof a loop and an extending string portion which passes through the loop so as to be frictionally retained when tension is applied to the opposite extending string portion. A template is provided with markings designating the prescribed location of the string connector relative to the keel stick for flying the device. When the device is used for dog-fighting competition, it includes a tail, a release pin connected to the tail to disconnect the string from the sail in response to pulling forces exerted on the tail by the kite of another competitor.

15 Claims, 8 Drawing Figures

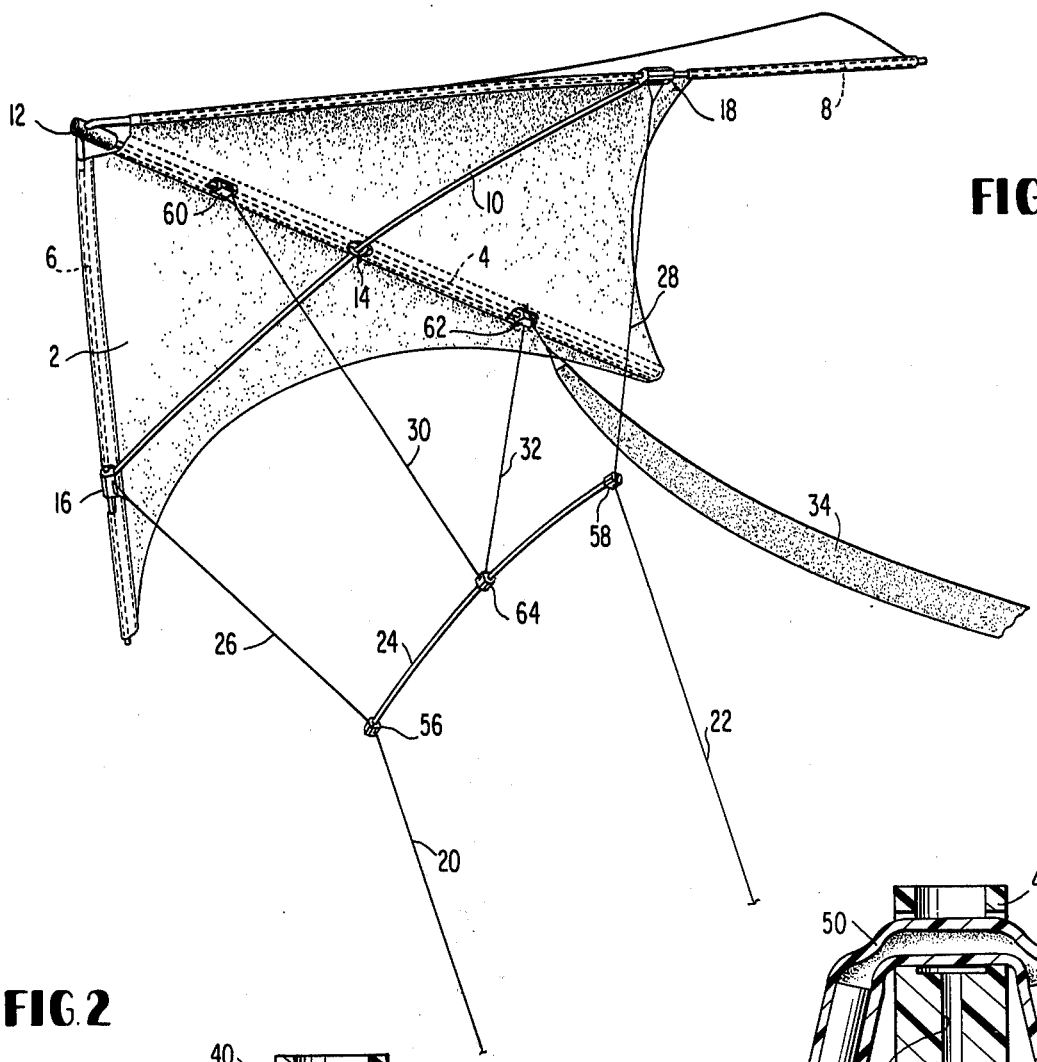
FIG. 1
FIG. 2
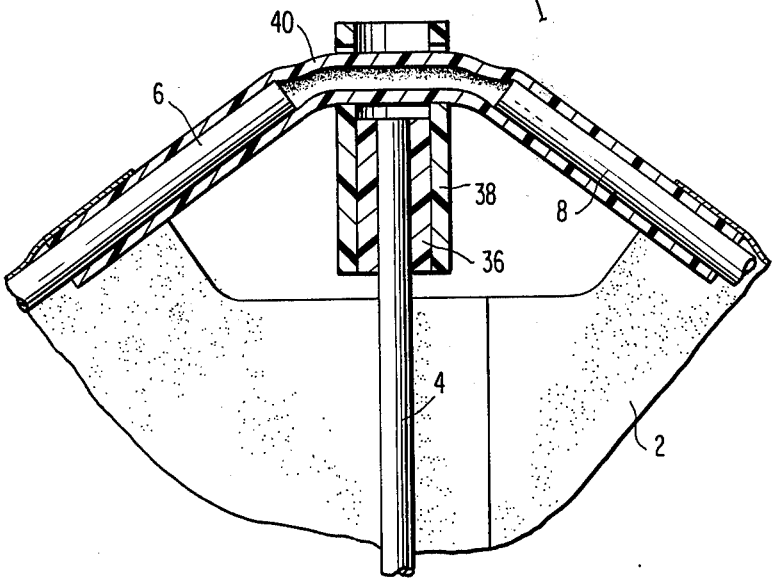
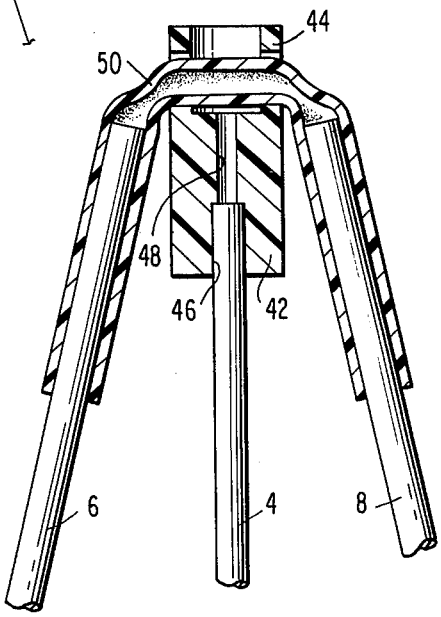
FIG. 3

FIG. 4
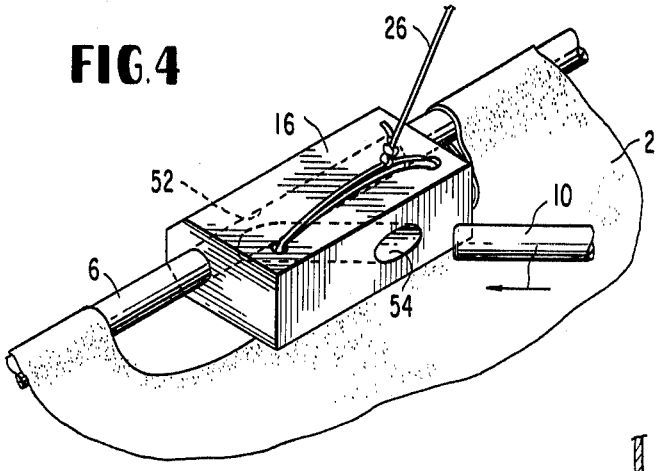
FIG. 5
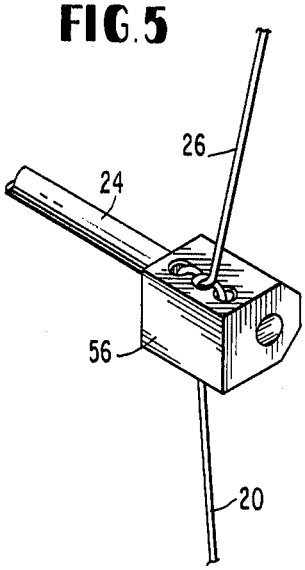
FIG. 7
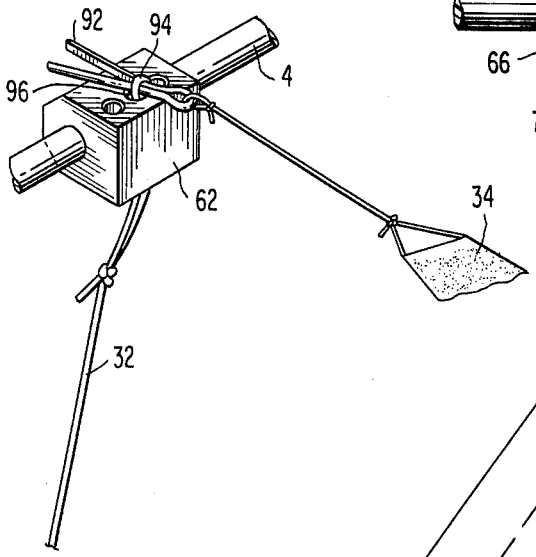
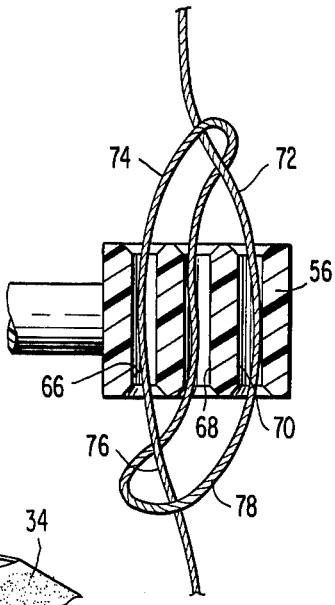
FIG. 6
FIG. 8
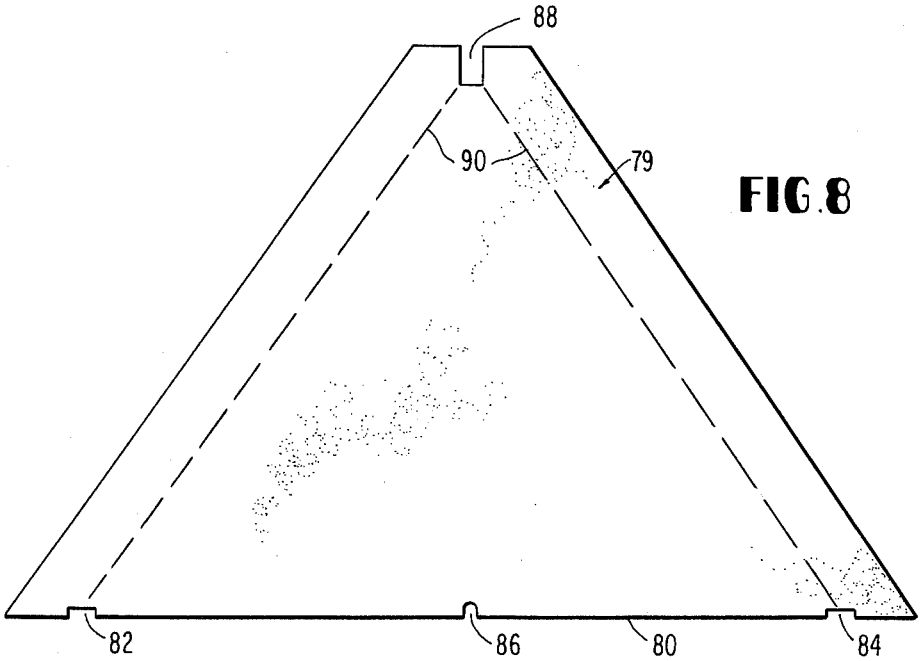

KITE-LIKE FLYING DEVICE AND ACCESSORIES THEREOF

BACKGROUND AND SUMMARY

This invention relates to improvements in kite-like flying devices, the improvements herein being particularly well suited to high performance devices of this type controlled by two strings, although certain features are adaptable to a wide variety of kite-like devices. Two string controllable kites are well known, recent examples thereof being disclosed by U.S. Pat. Nos. 3,746,286 and 4,026,504.

In one respect, the invention pertains to a connector which joins the sticks which intersect at the nose of the device. Connectors for this purpose are known, one of which is an integral plastic member having three prongs which fit respectively into the hollow leading ends of the keel stick and wing sticks. Flexible tube connectors have also been proposed as exemplified by U.S. Pat. No. 2,785,870 which issued to Wilbur Green on Mar. 19, 1957. According to the present invention, the nose connector is uncomplicated, easily manufactured and highly resistant to the impact which occurs when the device collides with the ground or another object. This connector includes a longitudinal element telescopically fitting over the leading end of the keel stick, and laterally extending flexible tubular elements located generally rearwardly of the leading end of the longitudinal element. The lateral elements are connected to the leading ends of the wing sticks and are located rearwardly of the leading end of the longitudinal element so the longitudinal element will receive and absorb the impact in the event of collision. Preferably, the lateral elements are opposite end portions of a resilient tube which extends transversely through the longitudinal element forwardly of the keel stick. In this position, the resilient tube will be stricken and deformed by the keel stick when the longitudinal element is subjected to an axial impact force of sufficient magnitude. It is also preferred that the longitudinal element has a reduced diameter resilient bore portion located forwardly of and aligned with the keel stick, whereby the energy of impact will be partially dissipated when the keel stick is driven into the reduced diameter bore upon impact.

The invention also includes an improved relationship between the wing sticks and the cross stick which is connected to the wing sticks and holds them in spaced relationship. This feature is similar to the connector used in the previously-mentioned Green patent in the respect that it is a rod-and-socket connection. However, the improvement herein utilizes socket bores which are slightly inclined relative to each other, and a cross rod which is flexed in order to be received by the socket bores, thereby establishing firm frictional engagement between the elements of the rod-and-socket connection means. Preferably, the socket bores are located in blocks mounted on the wing sticks.

Another feature pertaining to the connection between the cross stick and the wing sticks is an arrangement whereby this connection is slidable in a direction parallel to the respective wing sticks, enabling the cross stick to move slightly in a fore and aft direction during flight. Adjustably positioned cross sticks have been proposed, for example, in U.S. Pat. No. 3,347,500 which issued to Alfred E. Hartig on Oct. 17, 1967. In that case, however, the cross stick was attached to selected pairs of wing blocks and was incapable of movement relative to the wing sticks during flight of the device. According to this invention, the connector means which connects the opposite ends of the cross stick to the wing sticks enables the opposite ends of the cross stick to slide relative to their respective wing sticks. Strings are connected to the connector means for flying the device so that during flight the connector means will slide forwardly to an extent dependent upon the tension in the strings to change the shape and rigidity of the device.

A further feature of the invention relates to the manner in which strings are connected to a control rod or other elements of the device. Normally, simple knots, eyes and other simple structures are used for such connection, but there have been prior proposals which, like the present invention, utilize a member with a plurality of holes through which the string is threaded in a back-and-forth manner. For example, Zobl U.S. Pat. No. 3,317,165 discloses a bridle which is threaded through four adjacent holes in a connector plate. The threading of the bridle string through the holes provides sufficient friction to avoid sliding movement of the string therethrough. The present invention, rather than relying on frictional engagement between the string and the string-retaining member, provides friction between different portions of the string in a manner which deters abrasion of the string and simplifies adjustment of the string position. According to this feature which may be applied to devices other than kite-like structures, a solid body is provided with three bores through which the string is threaded back and forth to form, on opposite sides of the body, a loop and an extending portion of the string. At least one of the extending portions passes through the one loop adjacent thereto whereby the application of tension to the other extending portion will draw the one loop against the one extending portion to prevent longitudinal movement of the string relative to the body. Preferably, both extending portions of the string extend through their adjacent loops, and the bores are rounded at the exterior surface of the body to reduce abrasion and to reduce the size of the exterior surface beneath the loop so the loop will exert greater pressure on the extending portion therebeneath.

One feature of the invention is specifically adapted for use in connection with dogfighting competition. Unlike any prior devices known to the applicant, this involves means for disconnecting a flying string from the sail in response to pulling forces exerted on the tail by the kite of another competitor. Preferably, this string-disconnect mechanism includes a release pin which has a pair of bendable diverging legs. The disconnectible string is normally connected to the kite by means of a loop therein which passes through a bore on the kite body. The pin is positioned in the loop and serves normally to prevent the loop from being withdrawn through the bore. However, when sufficient tension is applied to the tail and pin when the tail is struck by the kite of another competitor, the pin is pulled from within the loop, enabling the loop to pass through the bore and become disconnected. The stricken kite will fall, but preferably it remains connected by another string so that it may be retrieved by the losing competitor.

A further feature pertains to the assembly kit for the kite-like flying device. While prior kites have often been provided with written instructions for positioning and adjustment of the bridle strings, it has been found that some kite-like devices are so critical that such instructions are inadequate or confusing. To overcome this problem, the kit is provided with a template which has markings which are aligned at a given longitudinal position on the frame of the kite. The template is provided for means for designating the location of the connector located at the apex of the V-shaped bridle as prescribed by the manufacturer.

The many aspects of the invention are susceptible to adaptation for use in connection with a wide variety of kite-like devices. This specification describes only a preferred embodiment, with the understanding that the invention may take many different forms.

BRIEF DESCRIPTION OF THE DRAWINGS

FIG. 1 is a perspective view of a preferred device according to the invention while in flight;

FIGS. 2 and 3 are sectional views of two preferred nose structures;

FIG. 4 shows a preferred connector for attaching a cross stick to the wing sticks;

FIGS. 5 and 6 illustrate a preferred string connector block;

FIG. 7 shows a trigger mechanism used in dogfighting competition, for disabling a kite when its tail is struck and pulled by a competitor; and FIG. 8 shows a template used for making preflight adjustments to the flying device.

DESCRIPTION OF A PREFERRED EMBODIMENT

As shown in FIG. 1, the preferred embodiment of the invention has a delta wing sail 2 of resin impregnated Dacron polyester fabric, connected to a frame or skeleton which includes a keel stick 4, wing sticks 6 and 8 and a cross stick 10. These sticks are fiber reinforced plastic rods sold under the trademark Fiberglas.

The sail 2 has seams which enclose the wing sticks 6 and 8 at the leading edges of the device. A longitudinal pocket in the sail receives the keel stick 4. The keel stick 4 and wing sticks 6 and 8 are connected together by a nose assembly 12. The cross stick 10 is swingably connected to the keel stick by an O-ring 14, and is connected at its opposite ends to connector blocks 16 and 18 which are slidably supported on their respective wing sticks. The device is flown from the ground by left and right control strings 20 and 22 which are attached to the ends of a rigid control rod 24. Rod 24 is connected to the kite by a control string harness formed by strings 26, 28, 30 and 32. A tail 34 is attached to the device for use in dogfighting competition.

Two preferred nose assemblies are shown in FIGS. 2 and 3. They hingedly interconnect the sticks 4, 6 and 8 and provide an impact resistant structure capable of surviving high speed crashes. The nose structure shown in FIG. 2 includes a first tubular piece 36 frictionally engaged on the leading end of the keel stick 4, a second larger tubular piece 38 frictionally engaged on the piece 36, and a third transverse tubular piece 40 which frictionally receives the leading ends of wing sticks 6 and 8. The transverse piece 40 extends through a transverse hole in the larger piece. The pieces 36, 38 and 40 are formed of a flexible resilient polyurethane elastomer. This nose structure enables the device to collapse to a compact storage position where the wing sticks 6 and 8 lie parallel to the keel stick 4. When the nose assembly is subjected to a strong impact, the composition and hollowness of the forwardly-projecting piece 38 enable it to cushion the blow; and, the transverse piece 40, being located forwardly of the keel stick 4, will provide resilient resistance to forward movement of the keel stick.

FIG. 3 shows a modified nose assembly with a greater impact-absorbing capability than the FIG. 2 structure. In FIG. 3, the longitudinal piece 42 is an integral injection molded member which has a hollow forward portion 44, a rear bore 46 which receives and snugly retains the forward end of the keel stick, and a resilient reduced diameter bore 48 located immediately forwardly of the keel stick. The transverse tubular element 50 is the same as the corresponding element in FIG. 2.

When the nose assembly of FIG. 3 strikes an object, the forward end of the keel stick 4 will initially be driven into the reduced diameter bore 48 to deform its resilient wall outwardly to dissipate some of the impact energy. Further movement of the keel stick brings it against the transverse tube 50 to absorb further energy as in the FIG. 2 embodiment.

The opposite ends of the cross stick 10 are connected to the wing sticks 6 and 8 by connector blocks 16 and 18 which are slidably mounted on their respective wing sticks and are provided with bores which receive the ends of the cross stick 10 to provide a rod and socket connection. The blocks are preferably formed of a plastic such as Delrin resin. As shown in FIG. 4, the wing block 16 has a bore 52 which slidably receives the wing stick 6, and a bore 54 for the cross stick. The bores 54 of the two wing blocks are generally aligned but slightly inclined relative to each other, by several degrees, thereby requiring that the cross stick 10 be slightly bowed or flexed before being engaged in the bores 54. When engaged, the resilience of cross stick 10, attempting to return to its unstressed linear form, creates a couple in the bores 54, thereby enhancing the frictional engagement of the cross stick with the connector blocks on the wing sticks 6 and 8.

The slidability of the wing blocks 16 and 18 on their respective wing rods enables the ends of the cross stick 10 to move relative to their respective wing sticks. This conforms the structure to harness adjustments and enhances the structure and flight characteristics of the device. This is particularly true in high winds which draw the cross stick 10 toward the nose, strengthening the skeletal structure and decreasing the angle of attack of the device, thereby diminishing lift which otherwise may cause the device to fly up and fold over itself.

As mentioned above, the device is controlled by two strings 20 and 22 attached to the control rod 24 which is connected by a harness of strings to the frame of the device. For the disclosed sail and frame configuration, the control rod 24 may be from 10 to 18 inches from the sail, 14 inches being an optimum distance. The control strings are preferably two continuous strings which extend at 20 and 22 from the operator to connectors 56 and 58 on the opposite ends of the control rod, and thence at 26 and 28 to the wing blocks 16 and 18 where they are threaded through holes and tied. The strings 30 and 32 which form the V-shaped bridle are preferably portions of a continuous string which has its opposite ends tied to blocks 60 and 62 which are immovably bonded to the keel stick 4 and are exposed by openings in the keel pocket of the sail 2. Thus, the bridle strings 30 and 32 are connected to forward and aft spaced points on the flying device. The midsection of the bridle string is connected to a bridle block 64 at the center of control rod 24, preferably at a location where the string 32 is slightly longer than string 30, and the connector is aligned with a point on the sail approximately one inch aft of the cross stick 10.

A typical string connector block 56 is shown in FIGS. 5 and 6. Blocks 58 and 64 are similar. Such blocks may in fact be used in other types of apparatus requiring adjustable affixation of strings, ropes, cords or other elongated flexible members. The connector block 56 in FIG. 5 is bonded to and a component of the control rod 24. It has three adjacent parallel bores 66, 68 and 70 through which the string 20, 26 is threaded back and forth to provide an extending portion 72 and a loop 74 on one side, and to provide an extending portion 76 and a loop 78 on the other side of the block 56. The string portions 72 and 76 pass respectively through the loops 74 and 78, so when tension is applied to one of the portions 72 or 76, the loop 78 or 74 on the opposite side of the block 56 is drawn against the string therewithin, thereby preventing longitudinal movement of the string relative to the block. To facilitate adjustments of the string position in the block, the block 56 is preferably formed of low friction material, the bores are significantly larger than the string diameter and the ends of the bores are rounded by beveling. The latter also reduces abrasion on the string and reduces the surface area where the loops 78 and 74 bear on the string portions 72 and 76 thereby causing the loop to exert a greater pressure to retain the string. The width of this surface is no greater than about two times the string diameter when viewed as shown in FIG. 6. Abrasion and friction are so low that a one ounce pull will draw the string through the block when the portions 72 and 76 are removed from their respective loops.

The position of the block 56 on the string 20, 26 is adjusted quite easily by pulling the loops to enlarge them, and then sliding the string in the bores of the connector block. When the block 56 is at the desired position, the string is tensioned. This tightens the loops and prevents longitudinal movement of the string relative to the control rod 24.

When not in use, the device of the invention is stored and carried in a collapsed position, with the sail folded and wrapped around the generally parallel sticks of the frame. The keel stick 4 and wing sticks 6 and 8 are connected to the nose assembly and are located in their respective seams or pockets of the sail 2. The cross stick 10 is parallel to the sticks 4, 6 and 8; and, it is retained on the keel stick by the O-ring 14. The control rod 24 is connected to the frame elements by the harness previously described.

To prepare the device for flight, the sail 2 is spread flat and the cross stick is turned and connected to the wing blocks 16 and 18. The bridle and control strings are adjusted. As bridle adjustment and cross stick location are often critical, the kit preferably includes the template 79 shown in FIG. 8. This template is a triangular sheet imprinted with instructions for its use. Indicia on the template designates that its lower edge 80 is to be positioned against the keel stick 4. Notches 82, 84 and 86 on this edge are configured and marked for alignment respectively with the keel rod blocks 62 and 60 and cross stick 10. This edge of the template assures proper initial positioning of the cross stick 10. The apex of the template is notched at 88 to receive the bridle block 64 of the control rod assembly. Broken lines 90 printed on the template 79 represents the appropriate initial positions of the bridle strings 30 and 32. In use, the edge 80 of the template is placed against the keel stick at a longitudinal position where the notches 82 and 84 receive the keel stick blocks 62 and 60. If necessary, the cross stick 10 is moved until it fits into notch 86. The lengths of the bridle strings 30 and 32 are adjusted until they conform to the broken lines 90 and the bridle block 64 is in the notch 88.

The device is flown by extending both control strings 20 and 22 to the operator who holds one string in each hand, and thrusting the device upwardly into the wind. After it ascends sufficiently, the operator may cause it to move from side-to-side, loop, dive, sweep, form figure-eights or perform other maneuvers throughout the downwind hemisphere by applying differential amounts of tension to the control strings. The wing design captures the wind and converts it into lift, acceleration and forward motion which often is significantly greater than the wind velocity.

While in flight, the device will undergo changes in its configuration which are dependent upon the wind conditions. The frame will also become more rigid as the wind forces and control line tension increase. This characteristic is due to the ability of the ends of the cross stick 10 to slide relative to the wing sticks. As the wind force increases, control string tension will pull the wing blocks 16 and 18 toward the nose to rigidify the frame structure and improve its ability to withstand the wind forces encountered.

The high performance device of the invention is well adapted for use in competitive events such as dogfighting. Traditionally, dogfighting kites have been provided with tails so that each competitor may fly his kite into the tail of his opponent, attempting to inflict damage on the tail. The present invention envisions a simple but effective improvement for use in dogfighting events, wherein means are provided for disconnecting the kite string from the sail in response to pulling forces exerted on the tail by the kite of another competitor.

The preferred string disconnect mechanism for dogfighting competitors is shown in FIG. 7. The aft bridle string 32 is connected to the aft keel block 62 by a release pin 92 which is preferably a cotter pin permanently secured to the tail 34. A suitable tail is a fifty foot length of fabric. The bridle string 32 is tied to form a flexible loop 94 which extends through a transverse bore 96 in the block 62 and around the cotter pin 92. When a sufficient tugging force is delivered to the pin 92 by the tail 34 of an attacked kite, the pin 92 moves axially and out of the loop 94, enabling the loop to pass through the bore 96 to disconnect the string from the block 62 and sail 2. The stricken kite will fall to the ground, where its recovery may be facilitated by the other strings which have not been disconnected.

The sensitivity of the tail release mechanism may be adjusted quite easily, simply by bending the diverging legs of the cotter pin 92 to change their angle of divergence. This changes the magnitude of the pulling force required on the tail to disconnect the string from the sail.

Persons familiar with the field of this invention will quickly recognize that many of the disclosed features may be adapted to a variety of different types of kites, and are susceptible to many potential modifications. Recognizing that such adaptations and modifications will occur, it is emphasized that the invention is not limited to the preferred embodiment disclosed herein. Rather, the invention encompasses a wide variety of structures which fall within the spirit of the following claims.

I claim:

1. A kite-like flying device including, a sail of flexible sheet material, a keel stick for stiffening the longitudinal centerline of the sail, wing sticks for stiffening the leading edges of the sail, a connector for connecting the leading end of the keel stick to the leading ends of the wing sticks, said connector including a longitudinal element and a pair of lateral elements extending outwardly from the longitudinal element, said longitudinal element telescopically fitting over the leading end of the keel stick, said lateral elements being flexible tubular elements located rearwardly of the leading end of the longitudinal element whereby the longitudinal element will receive and absorb the impact in the event of collision, said lateral elements being connected to the leading ends of the wing sticks, wing connectors slidably mounted on said wing sticks so as to move during flight of the device, said wing connectors having bores which are slightly inclined relative to each other, a cross stick having its ends located in said bores, said cross stick being resiliently flexed to establish firm frictional engagement of the cross stick within said bores, a control rod, a first set of control strings connecting the control rod to the sail, and a second set of strings extending from the control rod to the operator of the device, said first set of strings including strings connected to the wing connectors so the location of the wing connectors and cross stick will move in response to changes in the control strings to change the shape and rigidity of the device, at least one of said strings being connected to the control rod by a connector which has a set of at least three generally parallel bores, said string extending back and forth through said bores to form exposed loops, a portion of said string extending through one of said loops to prevent longitudinal movement of the string relative to the control rod when the string is under tension, a tail connected to the sail, means for disconnecting one of the strings from the sail when the tail is pulled, a template provided in a kit with said flying device, said template having markings thereon alignable with the flying device to position the template at a given longitudinal position on the device, and means on the template for designating the location of said control rod.

2. A kite-like flying device including, a sail of flexible sheet material, a keel stick for stiffening the longitudinal centerline of the sail, wing sticks for stiffening the leading edges of the sail, a connector for connecting the leading end of the keel stick to the leading ends of the wind sticks, said connector including a longitudinal element and a pair of lateral elements which extend outwardly from the longitudinal element and are connected to the leading ends of the wing sticks, said longitudinal element telescopically fitting over the leading end of the keel stick, said lateral elements being opposite end portions of a resilient tube which extends transversely through said longitudinal element rearwardly of the leading end of the longitudinal element and forwardly of the keel stick whereby the longitudinal element will receive and absorb the impact in the event of collision, and the resilient tube will be stricken and deformed by the keel stick when the longitudinal element is subjected to an axial impact force.

3. The device of claim 2 wherein the longitudinal element has a resilient bore portion located forwardly of and aligned with the keel stick, said resilient bore portion having a smaller cross section than the keel stick whereby the energy of impact will be partially dissipated when the keel stick is driven into the resilient bore portion in response to an axial impact force received by the longitudinal element.

4. A kite-like flying device including a sail of flexible sheet material, a pair of wing sticks which sweep rearwardly and are connected to the sail, a unitary cross stick extending transversely of the device, said cross stick having a linear form when it is unstressed, a pair of rod-and-socket connection means connecting the opposite ends of said unitary cross stick to said wing sticks, each of said connection means having a rigid member with a cross stick-receiving socket bore which is elongated and engaged with an end of said unitary cross stick, said cross stick-receiving socket bores being slightly inclined relative to each other, said cross stick being flexed from its unstressed linear form when received in the bores to create force couples in the bores and thus establish firm frictional engagement between said rod-and-socket connection means and said unitary cross stick.

5. A kite-like flying device including, a sail of flexible sheet material, a pair of wing sticks which sweep rearwardly and are connected to the sail, a cross stick extending transversely of the device, connector means connecting the opposite ends of the cross stick to the wing sticks and enabling the opposite ends of the cross stick to slide longitudinally of their respective wing sticks, and strings connected to the connector means for flying the device whereby, when the device is flying, the connector means will move on the wing sticks under the influence of said strings to change the shape and rigidity of the device.

6. The kite-like flying device of claim 5 wherein the connector means are blocks slidable along the respective wing sticks, said blocks having bores receiving said cross stick, said bores being inclined relative to each other, said cross stick being resilient and being bowed to provide firm frictional engagement of the ends of the cross stick within said bores.

7. A kite-like flying device including a sail of flexible sheet material, a control member which includes a rigid connector, said control member being spaced from the sail, a set of strings which includes both a plurality of lengths of string which extend from the control member to the sail, and a length of string which extends from the control member to an operator of the device; a continuous string engaged with the rigid connector and extending therefrom in different directions to comprise two of said lengths of string, said connector being longitudinally movable on said continuous string for adjustment and also being longitudinally lockable on said continuous string during flight of the device, said connector being movable on said continuous string to make adjustments which affect the flight characteristics of the device by changing the respective lengths of string, said rigid connector being spaced from the sail and having a set of at least three generally parallel bores, said continuous string extending back and forth through the bores to form a pair of exposed loops located on opposite sides of the connector, said continuous string having a portion thereof lying between one of said loops and one surface of the connector to prevent longitudinal movement of said continuous string in one direction relative to the connector when the string is under tension, said string having another portion thereof which lies between the other one of said loops and another surface of the connector to prevent longitudinal movement of the string in another direction relative to the connector when the string is under tension, said connector being adjustably movable on said continuous string by pulling the loops to enlarge them and then sliding the continuous string in the bores of the connector until the connector is in a desired position, said connector being longitudinally lockable in said desired position by tensioning the continuous string to tighten the loops against the underlying portions of string.

8. The kite-like flying device of claim 7 wherein the control member is a control rod which includes a plurality of said rigid connectors.

9. The kite-like flying device of claim 8 wherein two said connectors are located at the left and right ends of the control rod, said string being a string in a harness which includes a left control string and a right control string which extend respectively through respective said sets of bores in said connectors, said left control string extending from the left side of the sail through the left set of bores in the manner described in claim 8 and thence to an operator of the device, said right control string extending from the right side of the sail through the right set of bores in the manner described in claim 8 and thence to an operator of the device.

10. The connector of claim 7 wherein the bores are rounded at the exterior surface of the body to reduce abrasion of an elongated member extending therethrough and to reduce the size of the exterior surface beneath said loop so said loop will exert greater pressure on the extending portion therebeneath.

11. A kite-like flying device for use in dogfighting kite competition, comprising a sail, a string extending from the sail to a participant in the competition, and a tail connected to the sail, means for disconnecting the string from the sail in response to pulling forces exerted on the tail, whereby the string will be disconnected from the sail when the tail is pulled by the kite of another competitor, said means for disconnecting the string from the sail including a block attached to the sail and provided with a transverse bore, a release pin attached to the tail, said string having a loop which passes through said bore and around said release pin, whereby axial movement of the release pin enables the loop to pass through the bore to disconnect the string from the block, said pin having a pair of bendable diverging legs on an opposite side of said loop from said tail, whereby bending the pin to change the divergence of the legs will change the magnitude of pulling force on the tail required to disconnect the string from the sail.

12. The device of claim 11 wherein the string is connected to the device at two spaced points, said disconnecting means being operable at only one of said points whereby the stricken device remains connected to the other spaced point to permit its recovery by the competitor.

13. A kit including a kite-like flying device and a template; said device having a sail of flexible sheet material, a frame, a V-shaped bridle connected to the frame and extending from an apex to forward and aft spaced points on the flying device, a connector located at the apex and connected to said bridle, said template having markings thereon alignable with the flying device to position the template at a given longitudinal position on the frame, and means on the template for designating the location of the connector prescribed for flying the device.

14. A kite-like flying device including, a sail of flexible sheet material, a keel stick for stiffening the longitudinal centerline of the sail, wing sticks for stiffening the leading edges of the sail, a connector for connecting the leading end of the keel stick to the leading ends of the wing sticks, said connector including a longitudinal element and a pair of lateral elements extending outwardly from the longitudinal element, said longitudinal element having a cylindrical bore portion telescopically fitting over the leading end of the keel stick, said lateral elements being flexible tubular elements located rearwardly of the leading end of the longitudinal element whereby the longitudinal element will receive and absorb the impact in the event of collision, said lateral elements being connected to the leading ends of the wing sticks, said longitudinal element having a resilient bore portion located forwardly of and aligned with the cylindrical bore portion and the keel stick, said resilient bore portion having a smaller cross section than the keel stick whereby the energy of impact will be partially dissipated when the keel stick is driven into the resilient bore portion in response to an axial impact force received by the longitudinal element.

15. A kite-like flying device including a sail of flexible sheet material, a pair of wing sticks which sweep rearwardly and are connected to the sail, a cross stick extending transversely of the device, a pair of rod-and-socket connection means connecting the ends of said cross stick to said wing sticks, each of said connection means including a wing block which is mounted on and is slidable longitudinally of its respective wing stick, each of said wing blocks having a cross stick-receiving socket bore which is elongated and engaged with an end of said cross stick, said cross stick-receiving socket bores being slightly inclined relative to each other, said cross stick having its ends located in the socket bores and being flexed to establish firm frictional engagement between the cross stick and said rod-and-socket connection means, control strings connected to the wing blocks whereby the location of the wing blocks on their respective wing sticks will change in response to changes in the control strings.

* * * * *